United States Patent [19]

LaFiandra et al.

[11] Patent Number: 4,584,699

[45] Date of Patent: Apr. 22, 1986

[54] X-RAY ANODE ASSEMBLY

[75] Inventors: Carlo LaFiandra, New Canaan; Gregory P. Hughes, Norwalk, both of Conn.

[73] Assignee: The Perkin-Elmer Corporation, Norwalk, Conn.

[21] Appl. No.: 568,777

[22] Filed: Jan. 6, 1984

[51] Int. Cl.[4] ..... H01J 35/10; H01J 35/26

[52] U.S. Cl. ..... 378/130; 378/144

[58] Field of Search ..... 378/132, 125, 133, 127, 378/130, 34, 144; 313/148

[56] References Cited

U.S. PATENT DOCUMENTS

| | | | |
|---|---|---|---|
| 4,118,042 | 10/1978 | Booth | 313/148 |
| 4,130,772 | 12/1978 | Küssel et al. | 378/130 |
| 4,238,682 | 12/1980 | Vratny | 378/34 |
| 4,238,706 | 12/1980 | Yoshihara et al. | 378/130 |
| 4,331,902 | 5/1982 | Magendans et al. | 378/144 |
| 4,342,917 | 8/1982 | Buckley | 378/34 |
| 4,475,223 | 10/1984 | Taniguchi et al. | 378/34 |

*Primary Examiner*—Alfred E. Smith
*Assistant Examiner*—T. N. Grigsby
*Attorney, Agent, or Firm*—Thomas P. Murphy; Edwin T. Grimes; Richard C. Wilder

[57] ABSTRACT

The present invention is directed to a rotating anode x-ray source assembly which is particularly adapted for effecting high x-ray emission from a conventional x-ray source for use in replicating VLSI circuits, and comprises a rotatable anode target ring, cooling water flow channels dispose adjacent the target ring for cooling the target ring during operation, an E-beam directed to a spot on the target ring towards the periphery thereof, the cooling water flow channel being constructed and arranged so that on a transverse plane with respect to the axis of rotation all diametrically opposed points on any diameter have the same cooling water density, thereby dynamically balancing the anode under all thermal conditions.

9 Claims, 4 Drawing Figures

X-RAY ANODE ASSEMBLY

FIELD OF INVENTION

This invention relates to x-ray lithography and, more particularly, to a rotating anode x-ray source assembly. Assemblies constructed in accordance with the concepts of this invention are particularly adapted, among other possible uses, for effecting high x-ray emission from a conventional x-ray source for use in replicating VLSI circuits.

This application is closely related to Ser. No. 568,775 entitled "X-ray Lithography System", and Ser. No. 568,776 entitled "A Mask Ring Assembly for X-ray Lithography", and Ser. No. 568,778 entitled "An X-ray Mask Ring Assembly and Apparatus for Making Same"; said applications being filed on even date herewith. All of said applications are assigned to the same assignee. The disclosures contained in said applications are incorporated herein by reference.

BACKGROUND OF INVENTION

It is well recognized that of prime importance in x-ray lithography, in addition to the need for good resolution, is the ability to process a large number of circuits in a short time. This dictates a short exposure time. In order to get a short exposure time generally requires increased power, which means that considerable heat is generated in the anode target ring. As a result rotating anodes are employed, which are water cooled. However, one of the problems encountered with such prior art assemblies is due to the heating of the cooling water, which changes the density, and hence the assembly becomes unbalanced creating a dynamic distribution which disturbs the exposure. After recognizing this and other deficiences of known assemblies, Applicants have directed their efforts at trying to devise an improved x-ray anode assembly which provides a dynamically balanced under all temperature conditions water cooled anode, as will become apparent as the description proceeds.

Related patents in this field include, inter alia, U.S. Pat. No. 3,743,842 issued July 3, 1973; U.S. Pat. No. 3,892,973 issued July 1, 1975; U.S. Pat. No. 4,037,111 issued July 19, 1977; U.S. Pat. No. 4,085,329 issued Apr. 18, 1978; U.S. Pat. No. 4,185,202 issued Jan. 22, 1980; U.S. Pat. No. 4,187,431 issued Feb. 5, 1980; U.S. Pat. No. 4,215,192 issued July 29, 1980; U.S. Pat. No. 4,238,682 issued Dec. 9, 1980; U.S. Pat. No. 4,301,237 issued Nov. 17, 1981 and U.S. Pat. No. 4,335,313 issued Jan. 15, 1982.

SUMMARY OF THE INVENTION

In order to accomplish the desired results the invention provides a new and improved x-ray anode assembly which has specific water flow channels inside the rotating anode so that it is always dynamically balanced under all conditions of temperature distribution.

Briefly, this and other objects of the present invention are realized in a specific illustrative x-ray anode assembly which includes a rotatable anode target ring; cooling water flow channel means disposed adjacent said target ring for cooling the target ring during operation; and means for directing an E-beam at a spot on the anode target ring towards the periphery thereof. In addition, means are provided for rotating the target ring and cooling water flow channel means with respect to the E-beam, and inlet and outlet means are furnished for the cooling water flow channel means. The cooling water flow channel means are constructed and arranged so that on a transverse plane with respect to the axis of rotation all diametrically opposed points on any diameter have the same cooling water density, thereby dynamically balancing the anode under all thermal conditions.

There has thus been outlined rather broadly the more important features of the invention in order that the detailed description thereof that follows may be better understood, and in order that the present contribution to the art may be better appreciated. There are, of course, additional features of the invention which will be described hereinafter and which will form the subject of the Claims appended hereto. Those skilled in the art will appreciate that the conception upon which the disclosure is based may readily be utilized as a basis for the designing of other systems for carrying out the several purposes of the invention. It is important, therefore, that the Claims be regarded as including such equivalent systems as do not depart from the spirit and scope of the invention.

Several embodiments of the invention have been choosen for purposes of illustration and description, and are shown in the accompanying drawings, forming a part of the specification.

DETAILED DESCRIPTION OF THE PRESENTLY PREFERRED EMBODIMENTS

Figure 1:
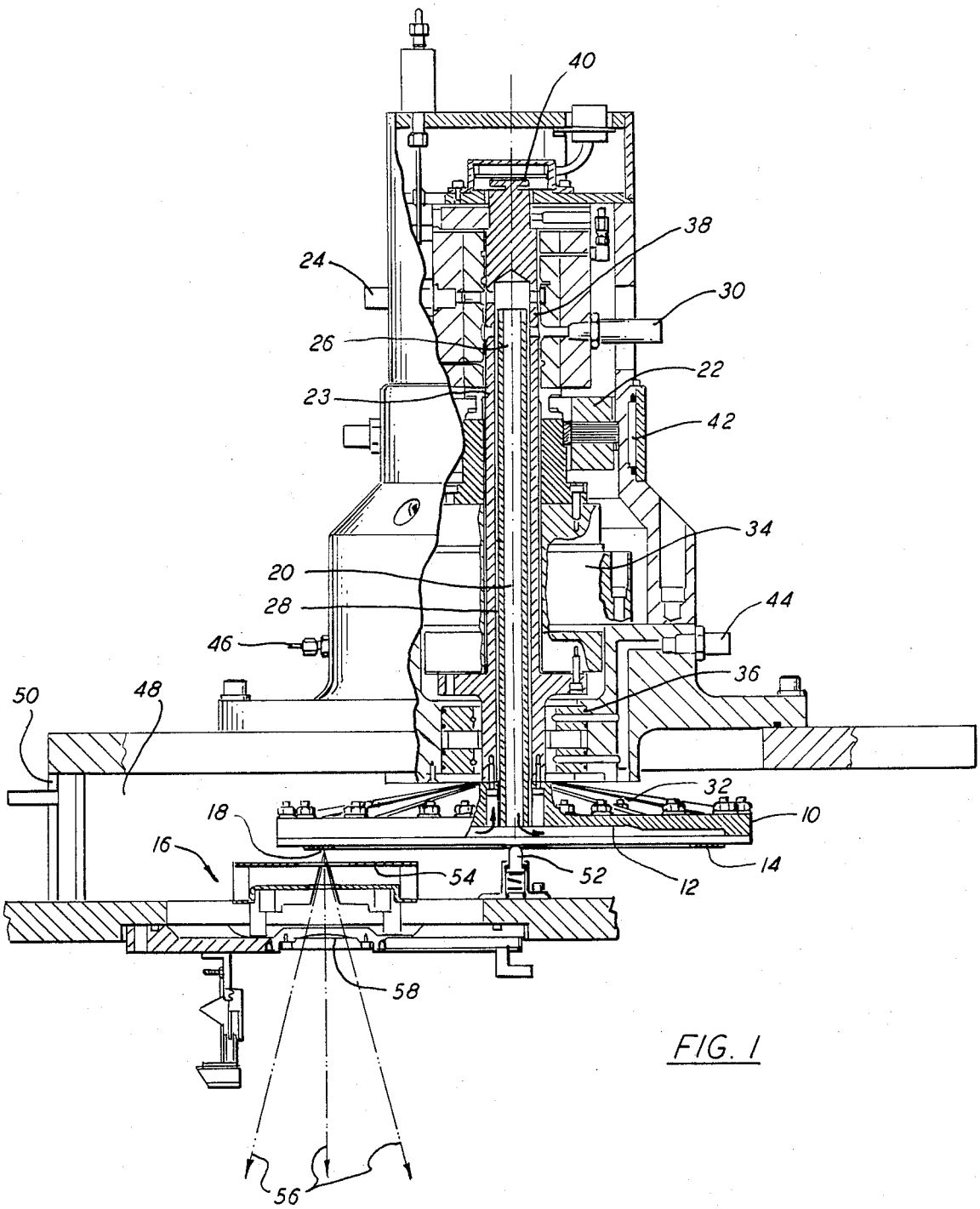
FIG. 1 is a side elevation, partially in section, of an x-ray anode assembly.

FIG. 1 depicts a rotating anode x-ray source assembly, which includes a housing 10 and cooling water flow channels 12 formed at one end of said housing, as will be described more fully hereinafter. A tungsten plate-like anode target ring 14 is fixedly attached to the housing, positioned so as to cover the water cooling channels.

Means such as, for example, an electron gun assembly indicated at 16, are furnished for directing an E-beam at a spot 18 on the anode target ring towards the periphery thereof.

In addition, means are provided for rotating the housing 10 and target 14 about an axis 20 with respect to the E-beam. As depicted in FIG. 1 the rotating means comprises an in-line motor 22 which drives a shaft or double concentric tube 23. Anode coolant enters the system through an inlet 24 and passes downwardly through the center of the tube 26 to the cooling water flow channels 12 and then returns from the channels through the outer passage in the tube 28 to the anode coolant outlet 30. The functions of the flow channels could be reversed if desired.

The housing 10 is provided with support ribs 32 and is fixedly connected to the tube 23 for rotation therewith. An air bearing 34 supports the shaft or tube 23 passing through a ferrofluidic vacuum seal 36. The motor 22 is attached to the other side of the air bearing and drives the system. An air bearing gland 38 provides coolant seals. It will be appreciated that there are no mechanical rubbing surfaces in this seal. An encoder 40 is attached at the tube's end to derive appropriate motor drive signals.

The motor 22 has a motor coolant jacket 42. A seal coolant connection is depicted at 44 and an air inlet at 46. A vacuum is carried in chamber 48 and a chamber coolant jacket is illustrated at 50. A ground contact is indicated at 52.

It will be appreciated that the low air bearing orbit coupled with the high degree of radial and axial stiffness serves to obtain a high degree of balance to the system, resulting in negligible inertia reactions being transferred to the system. In addition, this bearing has essentially infinite life and has a high natural frequency compared to a similar system utilizing ball bearings.

The electron gun assembly 16 includes an annular cathode or electron emitter 54 from which electrons are freed and directed to the spot 18 on the tungsten target ring 14 to generate x-rays indicated at 56. The cylindrical electron gun allows the x-rays generated to pass through it. This diverging cone of x-ray radiation then passes through a thin berylium vacuum window 58 into a helium filled exposure chamber.

The water cooled anode is rotated at a high speed such as, for example, about 8000 R.P.M. to withstand the heat generated by the focused E-beam. This prevents damage to the tungsten anode due to high thermal stresses generated at the location of E-beam impact 18.

Figure 2:
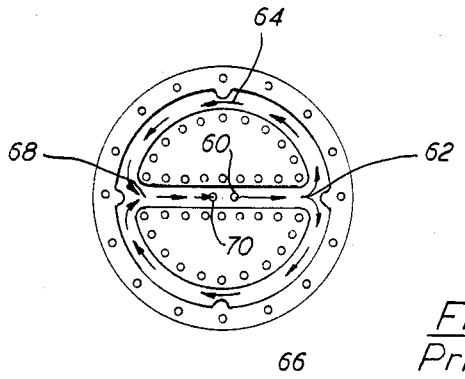
FIG. 2 Prior Art
FIG. 2 depicts the configuration of cooling water flow channels in the rotating anode according to the prior art.

The prior art rotating anode x-ray source assembly as heretofore proposed mounted the anode target ring on ball bearings and employed cooling water flow channels such as those shown in FIG. 2. The water entered, as indicated at 60, at the middle and flowed outwardly to the periphery where it split in two directions, as indicated at 62, and flowed around the periphery as depicted at 64 and 66. When the water reached the point indicated at 68, the two paths recombined and passed radially inwardly to a central outlet 70. This structure had problems. The coldest water is where it enters at 60 and the hottest water is where it leaves at 70. As a result, the density of the cooling water is different at all points along its path. If the difference in density is taken into account and the distribution thereof, the center of gravity is not on the axis of rotation of the water. Actually, the center of gravity varies depending on the water temperature and, accordingly, the hotter the water becomes the more the center of gravity will shift. This system is dynamically out of balance which causes dynamic disturbances, thereby disturbing the exposure. This is particularly important due to the high speeds of rotation involved.

Figure 3:
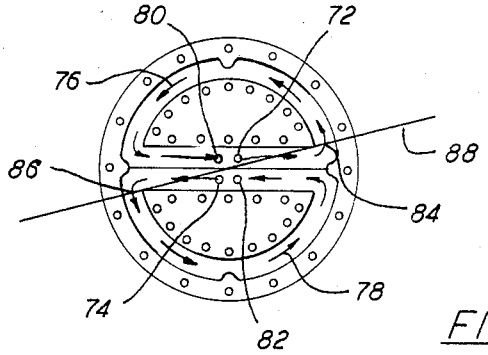
FIG. 3 shows the configuration of cooling water flow channels in the rotating anode according to the concepts of the present invention.

In order to overcome the foregoing problems, Applicants have found a way to dynamically balance the system and maintain the center of gravity of the water on the axis of rotation regardless of the temperature. As seen in FIG. 3, the water enters at 72 and 74, travels radially outwardly and then around in a circular path at 76, 78 and then radially inwardly to exit at 80, 82, respectively. It will be appreciated that the flow channels are constructed and arranged so that on a transverse plane with respect to the axis of rotation all diametrically opposed points 84, 86 on any diameter 88 have the same cooling water temperature, and hence the same cooling water density, with resulting maintenance of the system's dynamic balance under all thermal conditions.

Figure 4:
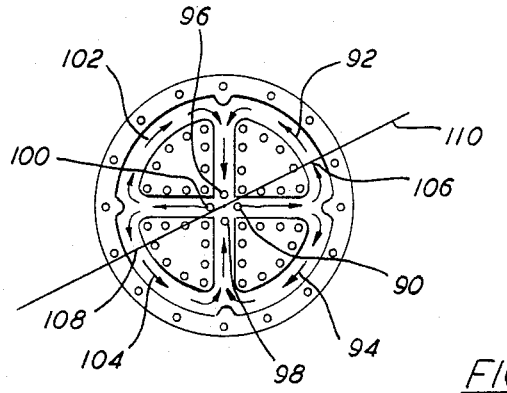
FIG. 4. is similar to FIG. 3, but shows another embodiment of the present invention.

FIG. 4 depicts another embodiment of the cooling water flow channels according to the invention. One half of the cooling water enters at 90 and flows outwardly to the periphery where it splits in two directions and flows around the periphery as indicated at 92 and 94. After the two paths of water flow one fourth of the way around the periphery, they flow radially inwardly and exit at 96 and 98, respectively. At the same time the other half of the cooling water enters at 100 and flows radially outwardly to the periphery where it splits in two directions and flows around the periphery as indicated at 102 and 106. After the two paths of water flow one fourth of the way around the periphery they join with the paths 92 and 94 and flow radially inwardly to exit at 96 and 98, respectively. There is thus formed four cooling water flow channels which form a cloverleaf-like coolant distribution so that on a transverse plane with respect to the axis of rotation all diametrically opposed points 106, 108 on any diameter 110 have the same cooling water temperature and hence the same cooling water density with resulting maintenance of the systems dynamic balance under all thermal conditions. Additional multiple channels produce the same result, the minimum having been described in FIG. 3.

It will thus be seen that the present invention does indeed provide a new and improved x-ray anode assembly which employs a highly accurate air bearing and which is dynamically balanced for all thermal conditions.

Although specific embodiments have been illustrated and described, it will be obvious to those skilled in the art that various modifications may be made without departing from the spirit and scope of the invention, which is to be limited solely by the amended claims.

What is claimed is:

1. In a lithographic system, a rotating anode x-ray source assembly comprising, in combination:

a rotatable anode target ring disposed on a transverse plane with respect to the axis of rotation of said rotating anode;

cooling water flow channel means disposed adjacent said target ring for cooling said target ring during operation;

means for directing an E-beam at a spot on said anode target ring towards the periphery thereof;

means for rotating said target ring and cooling water flow channel means with respect to said E-beam; and inlet and outlet means for said cooling water flow channel means, said cooling water flow channel means being disposed radially outwardly from said inlet and outlet means;

said cooling water flow channel means being constructed and arranged so that on a transverse plane with respect to the axis of rotation all diametrically opposed points on any diameter have the same cooling water density, thereby dynamically balancing said anode under all thermal conditions.

2. In a lithographic system, a rotating anode x-ray source assembly comprising, in combination:

a housing;

cooling water flow channel means formed at one end of said housing, being disposed on a transverse plane with respect to the axis of rotation of said rotating anode;

an anode target ring positioned to cover said water cooling channels;

means for directing an E-beam at a spot on said anode target ring towards the periphery thereof;

means for rotating said housing and target ring about an axis with respect to said E-beam; and inlet means and outlet means for said cooling water flow channel means, said cooling water flow channel means being disposed radially outwardly from said inlet and outlet means;

said cooling water flow channel means being constructed and arranged so that on a transverse plane with respect to the axis of rotation all diametrically opposed points on any diameter have the same cooling water density, thereby dynamically balancing said anode under all thermal conditions.

3. A rotating anode x-ray source assembly according to claim 2 wherein said anode is supported by an air bearing and is driven by an in-line motor.

4. A rotating anode x-ray source assembly according to claim 2 wherein said anode is supported by ball bearings and is driven by an in-line motor.

5. A rotating anode x-ray source assembly according to claim 2 wherein said anode target ring is of plate-like configuration and is fabricated from tungsten.

6. A rotating anode x-ray source assembly according to claim 2 wherein said anode target ring is of plate-like configuration and is fabricated from a tungsten and molybdenum combination.

7. A rotating anode x-ray source assembly according to claim 2 wherein said housing and target ring are mounted on a double concentric tube, which forms said inlet and outlet means, and said tube is supported on an air bearing.

8. A rotating anode x-ray source assembly according to claim 2 wherein said cooling water flow channel means comprises a first channel wherein one half of the cooling water enters at the center and flows radially outwardly and one half way around the periphery and then radially inwardly to exit at the center, and a second channel wherein the other half of the cooling water enters at the center and flows radially outwardly and one half way around the periphery and then radially inwardly to exit at the center, and the flow of cooling water in said second channel being in the opposite direction with respect to the flow of cooling water in said first channel.

9. A rotating anode x-ray source assembly according to claim 2 wherein said cooling water flow channel means is in the form of at least four cooling water flow channels which form a cloverleaf-like coolant distribution.

* * * * *